US011867490B2

(12) United States Patent
Gritskevitch et al.

(10) Patent No.: US 11,867,490 B2
(45) Date of Patent: Jan. 9, 2024

(54) PORTABLE MACHINE FOR CONNECTING CHAIN LINKS AND AMMUNITION

(71) Applicant: JOHN COCKERILL DEFENCE SA, Loncin (BE)

(72) Inventors: Innokenty Gritskevitch, Liege (BE); Anthony Colomine, Mortier (BE); Nicolas Leonnard, Thiebaumenil (FR)

(73) Assignee: JOHN COCKERILL DEFENSE SA, Loncin (BE)

( * ) Notice: Subject to any disclaimer, the term of this patent is extended or adjusted under 35 U.S.C. 154(b) by 311 days.

(21) Appl. No.: 17/598,348

(22) PCT Filed: Mar. 23, 2020

(86) PCT No.: PCT/EP2020/058012
§ 371 (c)(1),
(2) Date: Sep. 27, 2021

(87) PCT Pub. No.: WO2020/193478
PCT Pub. Date: Oct. 1, 2020

(65) Prior Publication Data

US 2022/0187050 A1 Jun. 16, 2022

(30) Foreign Application Priority Data

Mar. 28, 2019 (EP) ..... 19165962

(51) Int. Cl.
*F42B 39/10* (2006.01)

(52) U.S. Cl.
CPC ..... *F42B 39/10* (2013.01)

(58) Field of Classification Search
CPC ..... F42B 39/10
USPC ..... 86/48
See application file for complete search history.

(56) References Cited

U.S. PATENT DOCUMENTS 2,344,443 A 3/1944 Mccordalvin et al.
2,356,158 A 8/1944 Hall
2,391,568 A * 12/1945 Hall ..... F42B 39/10
86/48

(Continued)

FOREIGN PATENT DOCUMENTS

CN 2069098 U * 1/1991 ..... F42B 39/10

*Primary Examiner* — Bret Hayes
(74) *Attorney, Agent, or Firm* — LEYDIG, VOIT & MAYER, LTD.

(57) ABSTRACT

A machine for attaching ammunitions intended to form a chain or strip with links of ammunitions or cartridges, including an ogive, a cartridge casing, and a cup that are essentially cylindrical, attached by links articulated to one another, each link having a first part attached to a second part, the first and second parts being offset relative to one another, the second part including a central loop or handle relative to a height of the link, defining an approximately semi-cylindrical opening, sized to be adjusted on the cartridge casing of a cartridge of given caliber, the first part including two central loops or handles but located, heightwise, respectively on either side of the central loop, the machine including: a first guideway for successively introducing the links detached from one another and guiding the links under an effect of gravity; a second guideway for successively introducing and guiding the cartridges.

6 Claims, 8 Drawing Sheets

(56) References Cited

U.S. PATENT DOCUMENTS

| | | | | | |
|---|---|---|---|---|---|
| 2,397,944 | A | * | 4/1946 | Bureau | F42B 39/10 221/116 |
| 2,412,747 | A | | 12/1946 | Parry | |
| 2,420,664 | A | * | 5/1947 | Hoskins | F42B 39/10 86/48 |
| 2,460,096 | A | | 1/1949 | Lyon | |
| 2,480,834 | A | | 9/1949 | Bureau | |
| 2,826,955 | A | * | 3/1958 | Jones | F42B 39/10 86/48 |
| 2,847,896 | A | | 8/1958 | Boothroyd | |
| 3,002,416 | A | * | 10/1961 | Casler | F42B 39/10 86/48 |
| 5,831,197 | A | * | 11/1998 | Bill | F42B 33/002 86/28 |

* cited by examiner

PORTABLE MACHINE FOR CONNECTING CHAIN LINKS AND AMMUNITION

CROSS-REFERENCE TO PRIOR APPLICATIONS

This application is a U.S. National Phase application under 35 U.S.C. § 371 of International Application No. PCT/EP2020/058012, filed on Mar. 23, 2020, and claims benefit to European Patent Application No. EP 19165962.2, filed on Mar. 28, 2019. The International Application was published in French on Oct. 1, 2020 as WO 2020/193478 under PCT Article 21(2).

FIELD

The present invention relates to the field of portable machines or tools, which may or may not be automatic, making it possible to attach ammunitions to one another quickly and easily using links to produce a flexible band or chain of ammunitions coupled to one another, so as to allow the automatic firing of a weapon such as a cannon. The invention can apply to all types of linked ammunitions, preferably but not exclusively medium-caliber ammunitions, that is to say, typically between 15 and 50 mm.

BACKGROUND

At this time, the use of dummy ammunitions, for example in the case of tests on automatic firing devices such as armored vehicle cannon loading robots, requires the assembly of a certain number of ammunitions quickly and manually in the form of strips.

The strips of ammunitions considered in the context of the present invention are typically made up of cartridges inserted or clipped in a flexible strip or chain using metal connections or links. FIGS. 1 and 2 show detailed views of standard links, respectively alone and in combination with a cartridge. The link strictly speaking 10 is made up of a first part 11 attached to a second part 12, both parts 11, 12 being generally articulated to one another, but not necessarily. The second part 12 includes a central loop or handle 13 relative to the height of the link 10, defining an approximately semi-cylindrical opening, sized to be fitted on the cartridge case 21 of a cartridge 20 of given caliber. The first part 11 includes two loops 14, 15 of this type, but located, heightwise, respectively on either side of the central loop 13. Each of these loops 13, 14, 15 generally includes, at its free ends, a small loop 16 oriented in the opposite direction, so as to define a flare allowing an easier insertion or removal of the cartridge (this small loop in fact ensures a certain elasticity in the corresponding handle). The upper loop 14 of the first part 11 can be extended by an essentially flat and rectangular part 17 extending upward and the lower loop 15 of the first part 11 can also be extended downward by an essentially flat part 18, ending with a finger 19 that is advantageously inserted into the extraction slot 22 of the cartridge 20 so as to guarantee the correct alignment of the cartridge in the chain.

Typically, the ammunition is inserted into an individual link, either by sliding, or by clipping, in the loops 14, 15 of the first part 11 (FIG. 3) and next, the created link-cartridge assembly 10, 20 is attached to the chain 23 already made by attaching the free central loop 13 at the end of the chain 23 to the new cartridge 20 between the loops 14, 15 of its link (FIG. 4).

However, it is known that the (re)loading of a linked chain of medium- or large-caliber ammunitions is often impossible to do with bare hands due to the excessive force required or the specific bulk of an armored vehicle turret, for example.

Currently, this need to attach ammunitions is often satisfied in a somewhat unorthodox manner by using an additional tool, such as a hammer or a mallet. In this case, the penetration of the cartridge in the handle (or handles) of a free link can be obtained by a hammer strike, or even using a foot.

It will easily be understood that this manual method is very approximate and that the relative final position of the ammunition with respect to the link can prove random and variable from one ammunition to another, which risks blocking the apparatus for which the ammunition chain is intended.

In the field of automatic linking, machines are currently known that are large, complex and nonportable, or for smaller calibers such as 7.62 or 9 mm, portable machines pushing or clipping the ammunitions in the links.

Document U.S. Pat. No. 2,460,096 discloses a motorized machine for producing chains of 20 mm ammunitions, having a wheel for loading cartridges, a means for supplying cartridges in the loading wheel, an assembly wheel for links formed with pockets for holding links around its periphery and having a stepwise rotational movement, a means for supplying links to orient them toward the assembly wheel, a carriage with alternating pistons having a fixed travel, a pair of pistons mounted on said carriage in spaced-apart circumferential positions relative to the axis of the assembly wheel of the links, one of the pistons being longer than the other and both pistons having their alternating paths respectively aligned with successive pockets on the periphery of the link assembly wheel. The pistons of the piston carriage push the cartridges in the links in the assembly wheel in order to create an ammunition chain, in two successive steps during the stepwise rotation of the assembly wheel.

Document U.S. Pat. No. 2,480,834 discloses a motorized mechanism in which a pushing guideway is driven by a to-and-fro movement located below the discharge orifice of a vertical hopper for small-caliber ammunitions, the successive cartridges therefore being pushed into the articulated loops of a chain of links arriving from a guideway on a conveyor belt, a rotating star wheel allowing a continuous operation of the machine.

Document U.S. Pat. No. 2,344,443 discloses a machine comprising a continuous conveyor belt made from flexible sheet metal including a plurality of open hollows in which a plurality of cartridges are inserted, means for bringing links for holding these cartridges into the hollows, a rotary drum having a plurality of grooves and alternating protrusions in its periphery, marrying the contour of the conveyor belt to engage and drive the latter and means of the cam type for pushing the cartridges into a predetermined position in the links when the cartridges are driven by the conveyor belt.

SUMMARY

In an embodiment, the present invention provides a machine for attaching ammunitions intended to form a chain or strip with links of ammunitions or cartridges, including an ogive, a cartridge casing, and a cup that are essentially cylindrical, attached by links articulated to one another, each link comprising a first part attached to a second part, the first and second parts being offset relative to one another, the second part including a central loop or handle relative to a height of the link, defining an approximately semi-cylindrical opening, sized to be adjusted on the cartridge casing of a cartridge of given caliber, the first part including two central loops or handles but located, heightwise, respectively on either side of the central loop, the machine comprising: a first guideway configured to successively introduce the links detached from one another and guide the links under an effect of gravity; a second guideway configured to successively introduce the cartridges and guide the cartridges under the effect of gravity; a moving mechanism comprising a first shaft, a second shaft, and a third shaft, the first, second, and third shafts being mounted parallel to one another and coupled by gears, the moving mechanism being configured to be set in motion by rotation of the third shaft, which is configured to drive, in a continuous movement, rotation of the first shaft in a counterclockwise direction and rotation of the second shaft in a clockwise direction, or vice versa, the first shaft including at least two gripping wheels each having slots regularly spaced apart and with a circular shape so as to drive the casings of the cartridges, the second shaft including at least two gripping wheels having slots regularly spaced apart so as to drive the cup or a rear part of the links, such that, when the moving mechanism is set in motion, each cartridge is presented by the rotation of the first shaft synchronously with the link presented by the rotation of the second shaft and is clipped transversely in the link; and an electric motor or a manual crank configured to set the third shaft in rotation.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
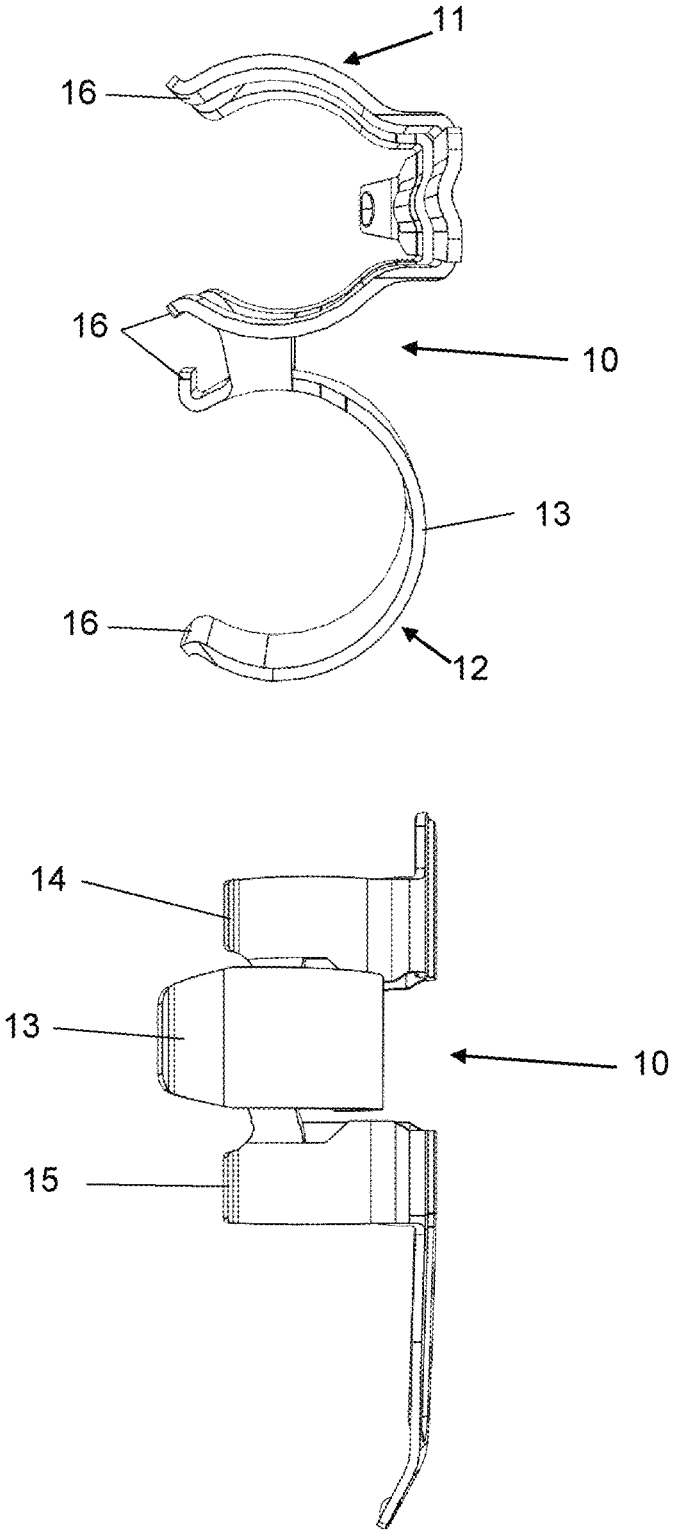
FIG. 1 shows a top view and an elevation view of an exemplary link of a strip of medium-caliber ammunitions.
Figure 2:
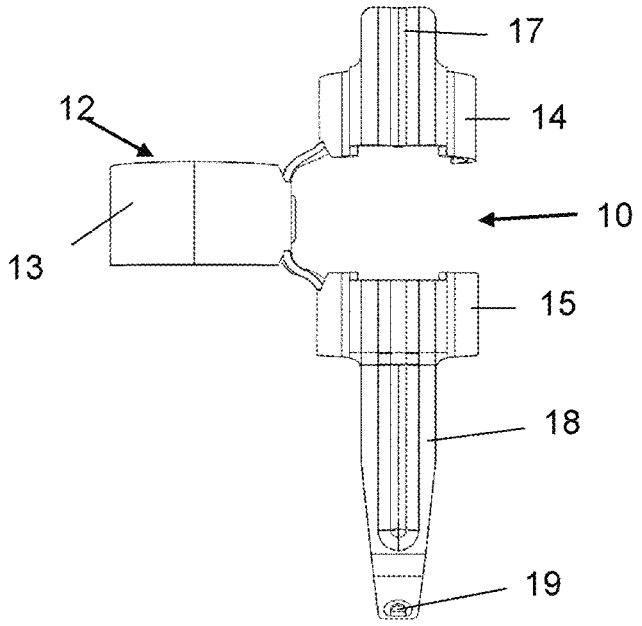
FIG. 2 shows respective elevation views of the link alone and of the cartridge introduced into the link.
Figure 2:
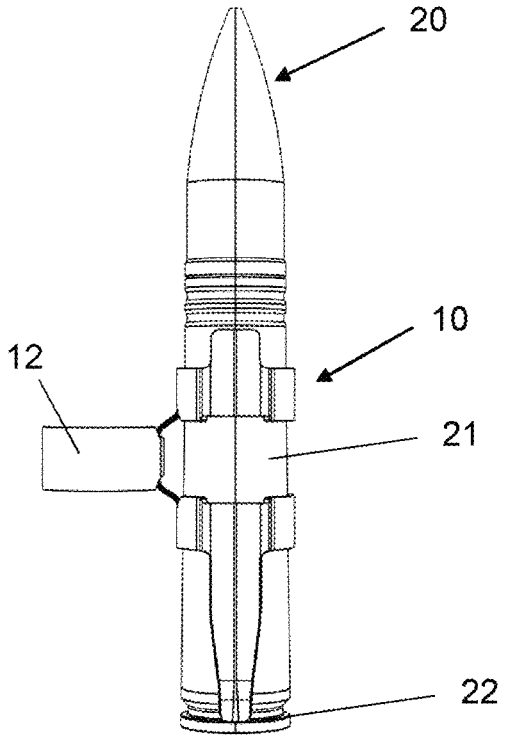
Figure 3:
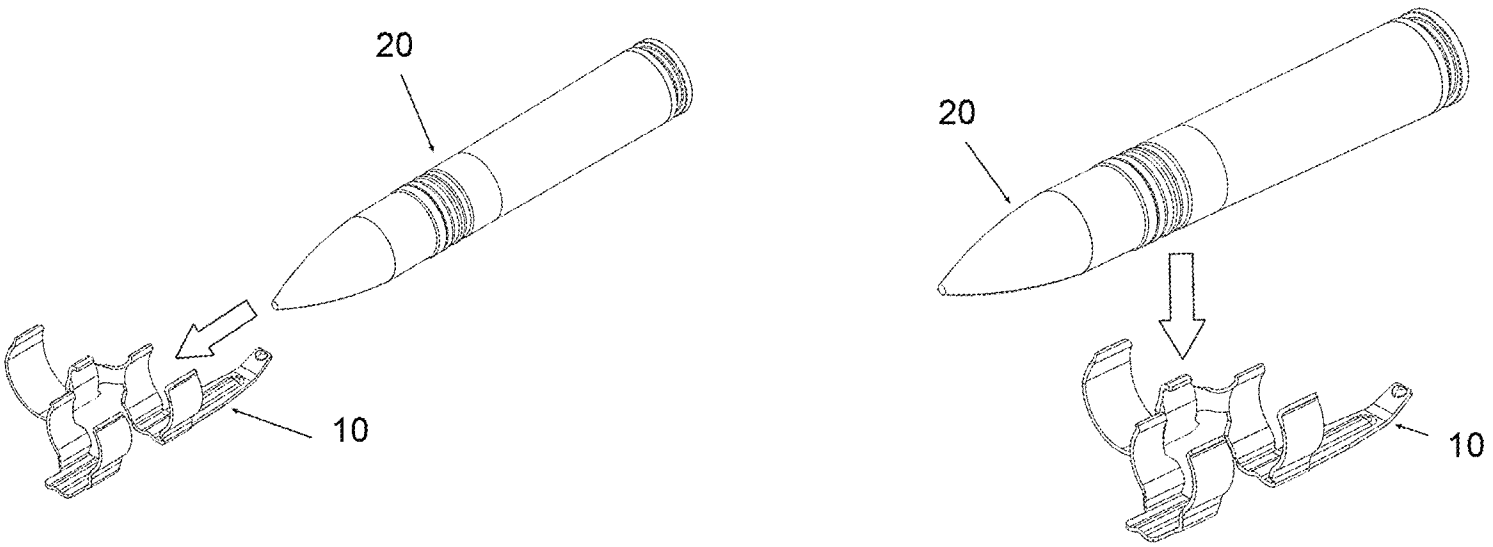
FIG. 3 shows the two usual linking modes.
Figure 4:
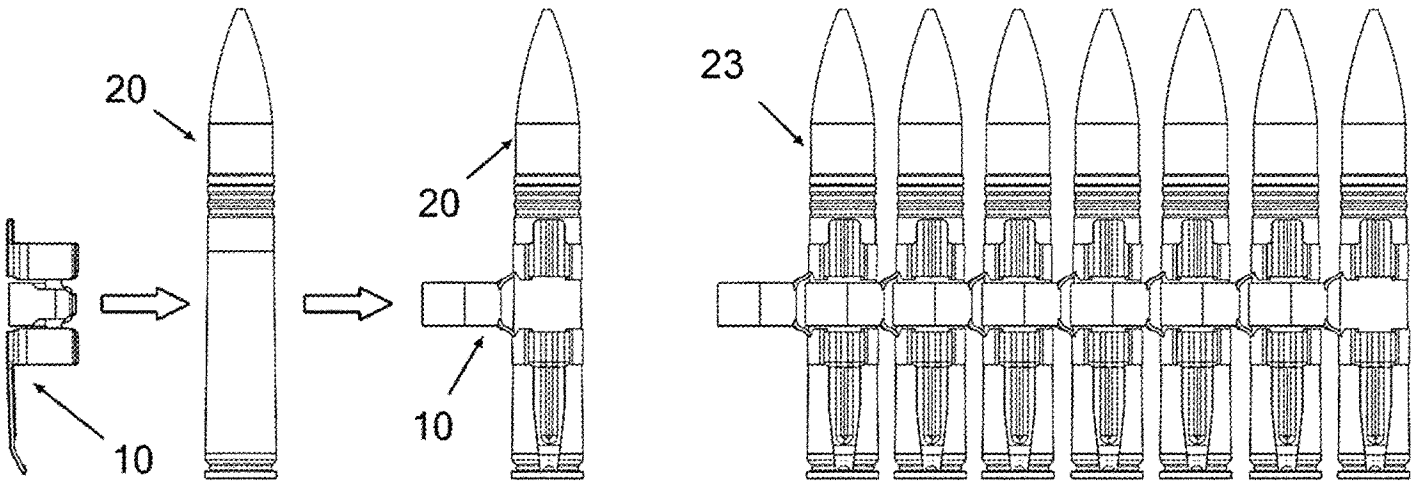
FIG. 4 shows the formation of a strip of ammunitions by linking cartridges from one to the next.

In an embodiment, the present invention provides a solution for the easy, safe and reproducible production of strips of ammunitions attached to one another, for example medium-caliber ammunitions.

In an embodiment, the invention reproduces, in an automated manner, the technique for manually linking a strip of ammunitions, so as to save time for cannon operators.

In an embodiment, the invention provides a compact and effective device designed to be easily integrated into a confined environment, like the inside of an armored vehicle turret.

In an embodiment, the invention produces strips of ammunitions quickly, typically a strip of 15 cartridges in less than 5 minutes, with no mechanical cranking force greater than 130 N, by manual actuation of the machine.

The present invention relates to a machine for attaching ammunitions intended to form a chain or strip with links of ammunitions or cartridges, including an ogive, a cartridge casing and a cup that are essentially cylindrical, attached from one to the next by links articulated to one another, each link being made up of a first part attached to a second part, both parts being offset relative to one another, the second part including a central loop or handle relative to the height of the link, defining an approximately semi-cylindrical opening, sized to be adjusted on the cartridge casing of a cartridge of given caliber, the first part including two loops also of this type but located, heightwise, respectively on either side of the central loop, said machine including:

- a first guideway, intended for the successive introduction of the links detached from one another and their guiding under the effect of gravity and a second guideway, intended for the successive introduction of the cartridges and their guiding under the effect of gravity;
- a moving mechanism provided with a first shaft, a second shaft and a third shaft, said shafts being mounted parallel to one another and coupled by gears, the moving mechanism being set in motion by the rotation of the third shaft, which drives, in a continuous movement, the rotation of the first shaft in the counterclockwise direction and the rotation of the second shaft in the clockwise direction, or vice versa, the first shaft including at least two gripping wheels each having slots regularly spaced apart and with a circular shape making it possible to drive the casings of the cartridges, the second shaft including at least two gripping wheels having slots regularly spaced apart making it possible to drive the cup or the rear part of the links, such that, when the moving mechanism is set in motion, each cartridge is presented by the rotation of the first shaft synchronously with the link presented by the rotation of the second shaft and is clipped transversely in said link (10);
- an electric motor or a manual crank for setting the third shaft in rotation.

According to preferred embodiments of the invention, the machine for attaching ammunitions further includes at least one of the following features or an appropriate combination of several of them:

- the gripping wheels of the respective cartridges and links are removable and adapted in terms of the shape of the slots to the caliber or the size of the cartridges and the respective links, the assembly being easily adaptable to other calibers or sizes by the replacement of the gripping wheels;
- to allow the transition from the 40 mm caliber to the 30 mm caliber, the first shaft includes a gripping wheel distal from the position by using the ogive of the cartridges and two twinned gripping wheels proximal from the position by using the ogive of the cartridges, the two twinned wheels having slots respectively adapted to the 30 mm caliber and the 40 mm caliber, the return to the 40 mm caliber being ensured by the removal of the wheel provided for the 30 mm caliber;

the two aforementioned twinned wheels are secured by at least one jack using a ball-lock;

the machine includes a to-and-fro mechanism with a finger that serves as a stop blocking the first link of the column located in the bottom of the first guideway, the finger unlocking and retracting sequentially during the rotation of the moving mechanism, so as to ensure the passage and the gripping of the links one after the other;

the first guideway is profiled such that the links present themselves with the openings of their loops toward the front of the machine;

The machine for attaching ammunitions according to the invention is for example suitable for producing strips of ammunitions with links having at least the central loop including, at its free ends, a small loop oriented in the direction opposite that of the main loop, so as to define a flare allowing an easier transverse introduction or removal of the cartridge, the upper loop of the first part being extended by an essentially flat and rectangular part extending upward and the lower loop of the first part being extended downward by an essentially flat part, ending with an index that is inserted into the removal slot of the cartridge.

Figure 5:
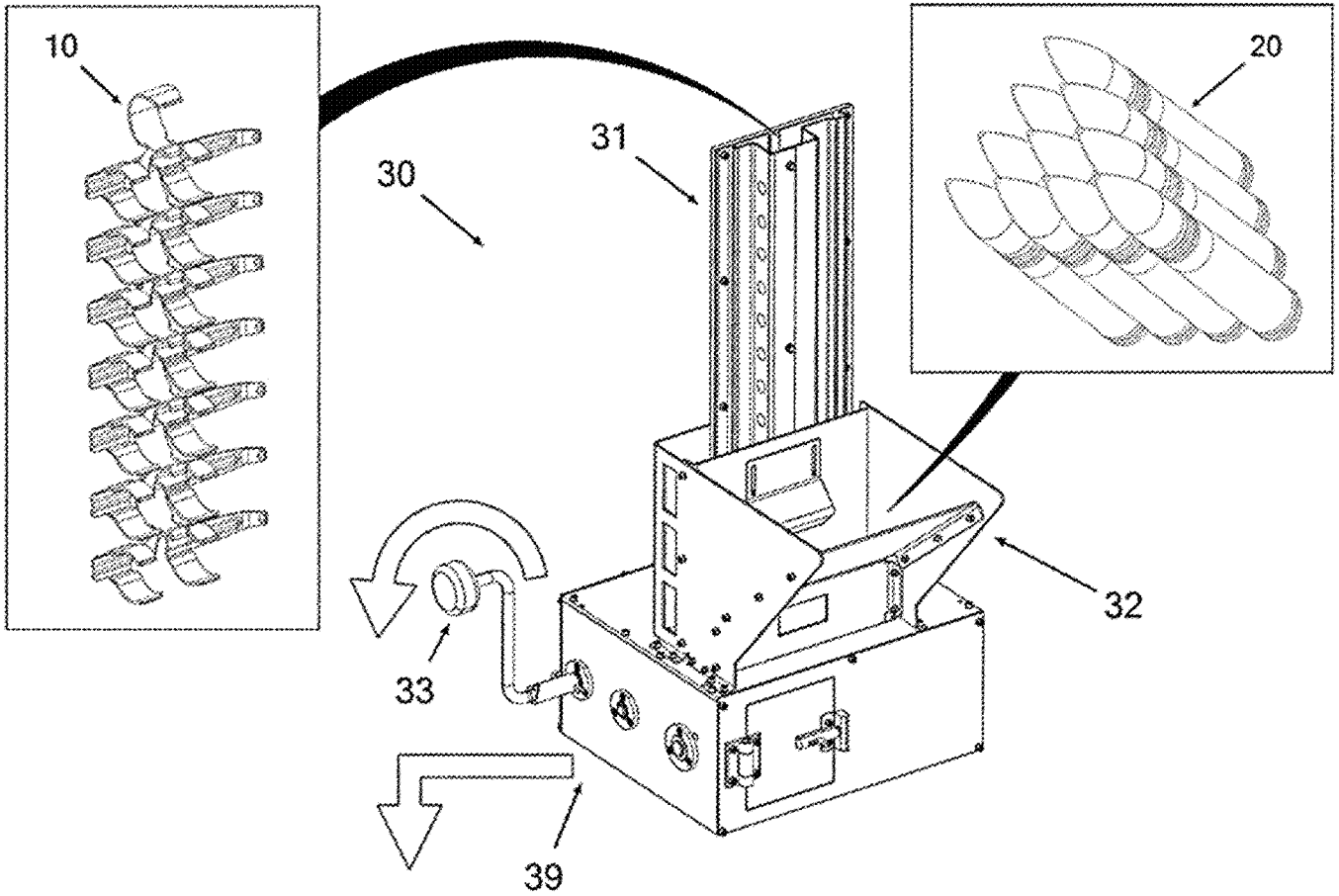
FIG. 5 shows a first perspective view, from the front, of a linking machine according to the present invention, also showing the general operating principle.
Figure 6:
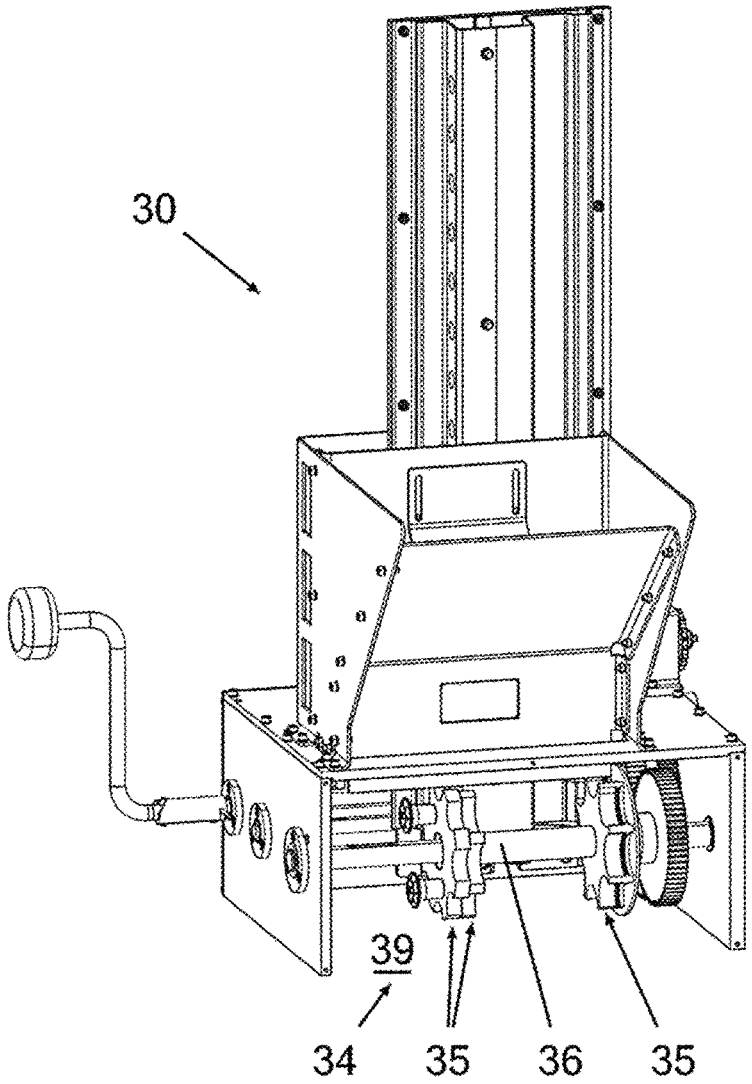
FIG. 6 shows a second perspective view, from the front, of the linking machine according to the present invention, where the front cover has been removed to show the detail of the moving mechanism.
Figure 7:
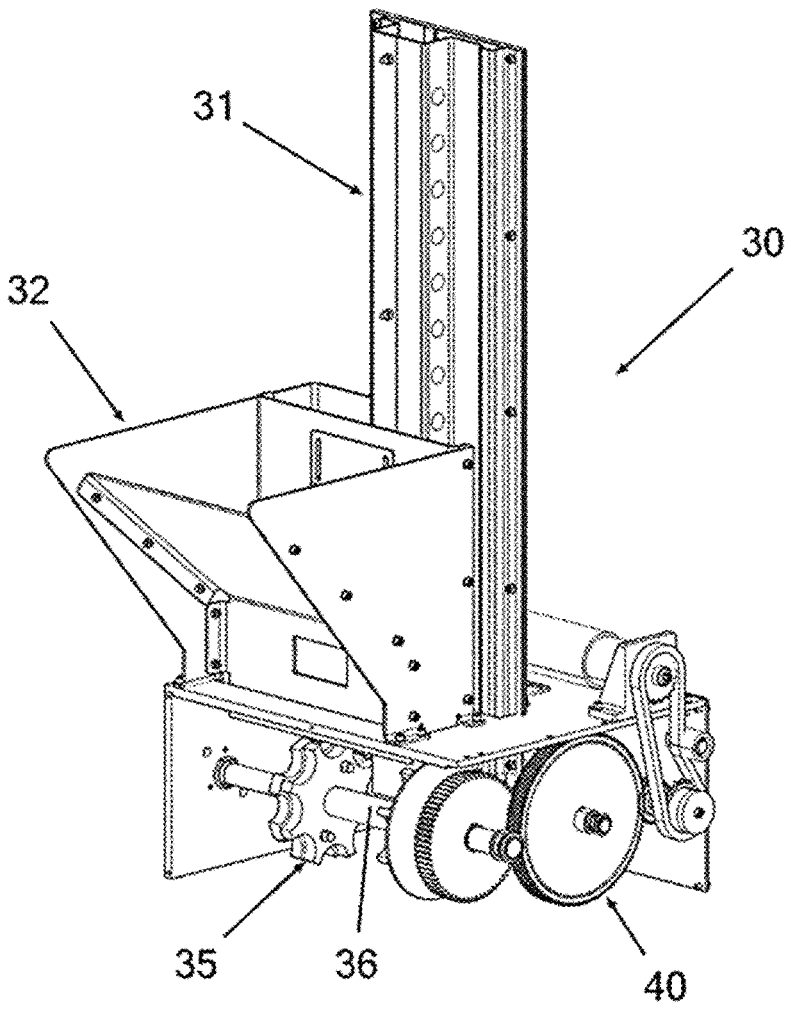
FIG. 7 shows another perspective view of the linking machine according the present invention, also showing the detail of the moving mechanism.
Figure 8:
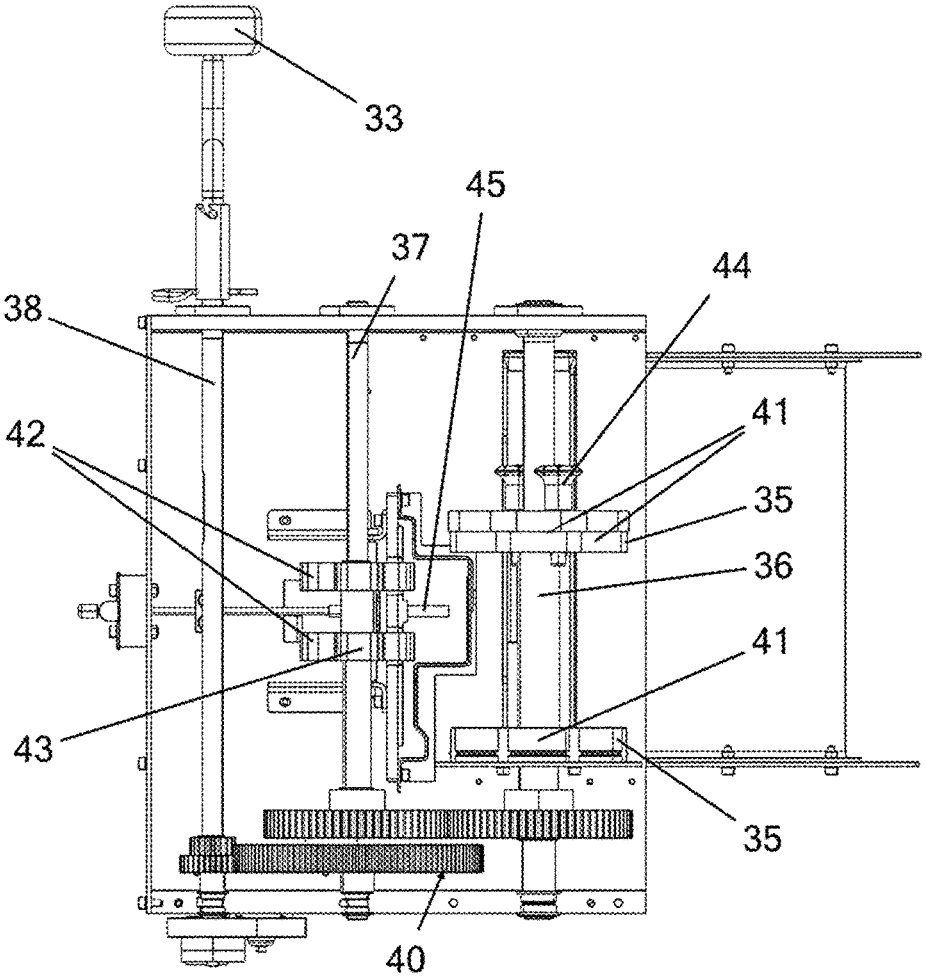
FIG. 8 shows an inner planar view of the linking machine according to the present invention, also showing the detail of the moving mechanism.

According to one preferred embodiment of the invention shown in FIGS. 5 to 8, the linking machine 30 includes a first guideway 31, intended for the successive introduction of links 10 detached from one another and a second guideway 32, intended for the successive introduction of ammunitions or cartridges 20, which are for example medium-caliber cartridges (30 and 40 mm in the considered example). The number of links 10 and the number of ammunitions 20 introduced into the machine are preferably identical.

The machine 30 can either be actuated manually, owing to a crank 33, or electrically, owing to an electric motor replacing the crank 33 (not shown).

In general, a moving mechanism 34 comprises a set of wheels 35 located on a shaft 36, said wheels 35 being intended to grip a cartridge 20. During the rotation of the shaft 36, the cartridge 20 is inserted into a link 10, which is presented in a synchronized manner by a shaft 37 to links 10 when the main shaft 38 is actuated by the motor or the crank 33.

When the machine 30 is actuated, the first cartridge 20 available in the bottom of the second guideway 32 is thus taken by the moving mechanism 34, placed in contact with the first available link 10 in the bottom of the first guideway 31, and the cartridge is clipped transversely in the link 10.

The machine 30 includes an outlet orifice 39, for example provided with a ramp ending in a collection box (not shown), through which the strip of linked ammunitions 22 is expelled by gravity.

The moving mechanism 34 therefore includes a first shaft 36 provided with a plurality of wheels 35 that are used to grip the cartridges 20. A second shaft 37 allows the advancement of the links 10. For example, the first shaft 36 rotates in the counterclockwise direction, while the second shaft 37 rotates in the clockwise direction. Both shafts 36, 37 are set in motion via a third shaft 38 secured to a crank 33 able to be actuated manually or by an electric motor. All three shafts 36, 37, 38 are parallel to one another and coupled by gears 40.

Advantageously, the first shaft 36 includes at least two wheels 35 having slots 41 evenly spaced apart with a circular shape making it possible to grip the cartridge casings 21 of the cartridges 20. The second shaft 37 also includes at least two wheels 42 having slots 43 making it possible to grip the cup of the links 10. During the rotation of the moving mechanism 34, the cartridge 20 is clipped longitudinally in the link 10.

Still more advantageously, the guideways 31, 32 and the gripping wheels 35, 42 are adapted to the size of the ammunitions and links. They are removable and interchangeable, the assembly being easily adaptable to other sizes or calibers. For example, the slots of the cartridge wheels 41 can be adapted to the 30 and 40 mm caliber ammunitions (the links are identical for these two calibers). The transition from 40 mm to 30 mm at the slots can advantageously be done using a jack using a ball-lock 44 acting by securing two twinned wheels 41.

Also advantageously, the linking machine according to the invention 30 includes a mechanism having a finger 45 that serves as a stop blocking the first link 10 and subsequently the entire column of links located in the bottom of the first guideway 31. The finger 45 then unlocks sequentially during the rotation of the moving mechanism 34.

Still advantageously, the machine will be provided with transport handles and will have a weight preferably not exceeding 40 kg.

The device according to the present invention includes the following advantages:

possibility of assembling a strip of dummy or real ammunitions;

portability by two people;

reduced time to assemble a strip of ammunitions;

adaptation to different calibers of ammunitions, for example from 20 to 40 mm;

reconstitution of a strip of ammunitions with already-used ammunitions;

manual or electric operation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

10 Link

11 first link part

12 second link part
13 loop of second part
14 loop of first part
15 loop of first part
16 small outer loop
17 flat and rectangular part
18 downward extension
19 Index
20 Cartridge
21 cartridge casing
22 Extraction slot
23 ammunition chain
30 linking machine
31 link supply guideway
32 cartridge supply guideway
33 Crank
34 moving mechanism
35 cartridge gripping wheel
36 first shaft
37 second shaft
38 third shaft
39 output of the ammunition chain
40 Gears
41 cartridge gripping slots
42 link gripping wheel
43 link gripping slots
44 ball-lock
45 link stop finger

The invention claimed is:

1. A machine for attaching ammunitions intended to form a chain or strip with links of ammunitions or cartridges, including an ogive, a cartridge casing, and a cup that are essentially cylindrical, attached by links articulated to one another, each link comprising a first part attached to a second part, the first and second parts being offset relative to one another, the second part including a central loop or handle relative to a height of the link, defining an approximately semi-cylindrical opening, sized to be adjusted on the cartridge casing of a cartridge of given caliber, the first part including two central loops or handles but located, heightwise, respectively on either side of the central loop, the machine comprising:

a first guideway configured to successively introduce the links detached from one another and guide the links under an effect of gravity;

a second guideway configured to successively introduce the cartridges and guide the cartridges under the effect of gravity;

a moving mechanism comprising a first shaft, a second shaft, and a third shaft, the first, second, and third shafts being mounted parallel to one another and coupled by gears, the moving mechanism being configured to be set in motion by rotation of the third shaft, which is configured to drive, in a continuous movement, rotation of the first shaft in a counterclockwise direction and rotation of the second shaft in a clockwise direction, or vice versa, the first shaft including at least two gripping wheels each having slots regularly spaced apart and with a circular shape so as to drive the casings of the cartridges, the second shaft including at least two gripping wheels having slots regularly spaced apart so as to drive the cup or a rear part of the links, such that, when the moving mechanism is set in motion, each cartridge is presented by the rotation of the first shaft synchronously with the link presented by the rotation of the second shaft and is clipped transversely in the link; and an electric motor or a manual crank configured to set the third shaft in rotation.

2. The machine for attaching ammunitions of claim 1, wherein the gripping wheels of the respective cartridges and links are removable, and wherein a shape of the slots of the gripping wheels are adapted to the caliber or a size of the cartridges and the respective links, the moving mechanism being adaptable to other calibers or sizes by replacement of the gripping wheels.

3. The machine for attaching ammunitions of claim 2, wherein, to allow transition from a 40 mm caliber to a 30 mm caliber, the first shaft includes a gripping wheel distal from a position by using the ogive of the cartridges and two twinned gripping wheels proximal from the position by using the ogive of the cartridges, the two twinned wheels having slots respectively adapted to the 30 mm caliber and the 40 mm caliber, a removal of the wheel provided for the 30 mm caliber being configured to provide a return to the 40 mm caliber.

4. The machine for attaching ammunitions of claim 3, wherein the two twinned gripping wheels are secured by at least one jack using a ball-lock.

5. The machine for attaching ammunitions of claim 1, further comprising:

a to-and-fro mechanism with a finger configured as a stop that blocks a first link of a column located in a bottom of the first guideway, the finger being configured to unlock and retract sequentially during rotation of the moving mechanism so as to provide a passage and a gripping of the links one after another.

6. The machine for attaching ammunitions of claim 1, wherein the first guideway is profiled such that the links present themselves with the openings of the central loops or handles of the links toward a front of the machine.

* * * * *